US007048236B2

(12) United States Patent
Benden et al.

(10) Patent No.: US 7,048,236 B2
(45) Date of Patent: May 23, 2006

(54) VERTICAL ADJUSTMENT APPARATUS FOR A KEYBOARD

(75) Inventors: Mark E Benden, College Station, TX (US); Jerome J Congleton, College Station, TX (US); Christopher A. Smith, Bryan, TX (US)

(73) Assignee: Neutral Posture, Inc., Bryan, TX (US)

( * ) Notice: Subject to any disclaimer, the term of this patent is extended or adjusted under 35 U.S.C. 154(b) by 0 days.

(21) Appl. No.: 10/767,704

(22) Filed: Jan. 29, 2004

(65) Prior Publication Data

US 2005/0167548 A1 Aug. 4, 2005

(51) Int. Cl.
*F16L 3/00* (2006.01)

(52) U.S. Cl. ..... 248/121; 108/138; 248/918

(58) Field of Classification Search ..... 248/121, 248/122, 123.11, 125.2, 132, 274.1, 276.1, 248/279.1, 280.11, 423, 421, 164, 918; 108/138, 108/145

See application file for complete search history.

(56) References Cited

U.S. PATENT DOCUMENTS

| | | | | |
|---|---|---|---|---|
| 2,581,023 | A * | 1/1952 | Jerick | 108/4 |
| 3,017,219 | A | 6/1962 | Mallet | 297/135 |
| 3,093,411 | A | 6/1963 | Mallet | 297/135 X |
| 3,336,076 | A | 8/1967 | Malitte | 297/148 |
| 4,032,103 | A * | 6/1977 | Ehrichs | 248/421 |
| 4,296,694 | A * | 10/1981 | Kobayashi | 108/116 |
| 4,453,764 | A | 6/1984 | Hennessy | 297/153 |
| 4,659,099 | A | 4/1987 | Malone | 297/153 X |
| 4,779,922 | A | 10/1988 | Cooper | 297/188 |
| 5,104,073 | A | 4/1992 | VanBeek et al. | 248/118.3 |
| 5,161,812 | A | 11/1992 | DeWeese | 297/344 |
| 5,311,210 | A | 5/1994 | O'Brien et al. | 345/168 |
| 5,452,950 | A | 9/1995 | Crenshaw et al. | 312/223.3 |
| 5,490,710 | A | 2/1996 | Dearing et al. | 297/162 |
| 5,893,607 | A | 4/1999 | Trimnell | 297/170 |
| 6,095,607 | A | 8/2000 | Wenzel | 297/344 |
| 6,135,548 | A | 10/2000 | McGuire | 297/163 |
| 6,296,312 | B1 | 10/2001 | Congleton et al. | 297/411 |
| 6,488,248 | B1 | 12/2002 | Watt et al. | 248/279 |
| 6,554,359 | B1 * | 4/2003 | Kohl et al. | 297/338 |
| 6,604,786 | B1 | 8/2003 | Benden et al. | 297/188 |
| 6,705,238 | B1 * | 3/2004 | Heckert | 108/145 |
| 2004/0144906 | A1 * | 7/2004 | Hill et al. | 248/421 |

OTHER PUBLICATIONS

"Neutral Posture® Sit/Stand Workstation for Office or Industry", Neutral Posture Ergonomics, Inc. © (P11,Jun. 1999).

(Continued)

*Primary Examiner*—Ramon O Ramirez
(74) *Attorney, Agent, or Firm*—Howrey LLP

(57) ABSTRACT

A vertical adjustment apparatus is described for use in the field of workstation design. The vertical adjustment apparatus is attachable to a workstation and operates to selectively raise and lower a device, such as a keyboard, such that the device may be utilized by a user in a seated position, as well by the user in a standing position, such that the apparatus allows the device to be elevated to a $95^{th}$ percentile standing elbow rest height. A locking means for to selectively lock an upper tray at a predetermined height above a base tray is also described. The apparatus may include a power means for adjusting the height of the upper tray over the base tray. A method of adjusting a device for use by a user in a seated and in a standing position is also disclosed.

25 Claims, 17 Drawing Sheets

OTHER PUBLICATIONS

"Providing High-Quality Products to Enhance Your Comfort, Safety and Productivity", Ergonomic Design Inc. © 1999.
"Give Yourself C.P.R. Comfort Productivity Risk Reduction", Cat Trak, Inc. © 1999.
Catalog Pricing: Keyboard Trays—depts.washington.edu web page; Jan. 24, 2004 (3 pgs.).
ComX Waterloo; www.compxnet.com web pages; Jan. 26, 2004 (17 pgs.).
www.suspanic.com web pages; Jan. 26, 2004 (2 pgs.).

* cited by examiner

VERTICAL ADJUSTMENT APPARATUS FOR A KEYBOARD

BACKGROUND OF THE INVENTION

1. Field of the Invention

The invention relates to an elevation apparatus for a device such as a keyboard or other workstation accessory. More particularly, this invention relates to a vertical adjustment apparatus to hold a device, such as a keyboard, mouse, and/or laptop computer, for a user to use while either sitting at the workstation or standing near the workstation. This allows a user to change from a seated to a standing position throughout the workday without moving the device from the apparatus.

2. Description of the Related Art

In the workplace, persons are often required to perform repetitive manual tasks in a sedentary position. By maintaining a sedentary position throughout the workday, the person can become fatigued without proper support. Remaining in that sedentary position may reduce blood flow through the legs as well. Utilizing ergonomic principles when designing furniture may increase worker productivity, decrease worker fatigue and absenteeism, and improve blood flow throughout the body.

Further, ergonomic principles dictate that it is desirable to properly support the hands, arms, and wrists of a seated person who is utilizing devices such as a computer keyboard, mouse, and/or laptop computer.

It is known in the workstation design industry that by varying a person's body position, fatigue is reduced. Without changing positions periodically, proper circulation is hampered. By changing body positions at multiple times throughout the day, a person can reduce stress and increase productivity.

One desirable way of changing body position is for a worker to switch from a seated to a standing position. Alternating from a seated to a standing position facilitates blood flow through the legs, which helps prevent fatigue and improves worker comfort. This sit-and-stand method of reducing worker fatigue is known in the furniture design field.

Several attempts at providing a comfortable keyboard support for a seated person are known. For example, it is known in the workplace design industry that it is possible to provide keyboard supports for use by a person in a seated position. For example, the approach of Trimnell described in U.S. Pat. No. 5,893,607 utilizes a computer keyboard holder attached to a chair. Trimnell's keyboard holder attaches to the chair legs, and is for use by a person in the seated position, not the standing position. Alternatively, U.S. Pat. No. 4,779,922 to Cooper describes a chair with a built-in computer workstation. U.S. Pat. No. 5,104,073 to VanBeek describes the holder in front of a chair to reduce the chance of the user incurring repetitive stress injuries. U.S. Pat. No. 5,422,950 to Crenshaw describes a school desk computer workstation, while Dearing (U.S. Pat. No. 5,490,710) describes the holder built into a chair arm.

Commercial products such as X-TENSION ARM by Cal Trak, Inc. of Broomfield, Colo., and ERGOREST by Ergonomic Design, Inc. of Northglenn, Colo., are available which provide for the attachment of a keyboard support to a chair, the support being mounted at a given height for a seated user.

In each of these approaches, the holder is designed for one position of a user, generally seated. None describe a system for providing a keyboard support for use by a person standing near a chair. Further, when a user is practicing those prior designs, but would like to stand to take advantage of the sit-and-stand principle, modifications to the work area would be required. For instance, combining two prior design support systems could possibly be used to accommodate different user positions.

It is known to provide two keyboard supports at one workstation: one permanently mounted at a height suitable to a person in a seated position, and one permanently mounted at a height suitable to a person in a standing position. However, the addition of another piece of furniture in the work area is not always desirable in many space-limited workplace designs. Further, the same keyboard, mouse, and/or computer may be utilized by multiple workers throughout the day. Therefore, it is desirable to have accessory supports, which are capable of adjusting to the different depths, angles, and heights to accommodate the differently-statured individuals who may utilize the same keyboard support. Additionally, the use of radio frequency or infra red communication makes the use of a cordless keyboard, mouse, or computer feasible in the modern workplace.

It is also known to provide one device that is mountable to a chair at various locations, such that the sit-and-stand principle may be employed. For instance, U.S. Pat. No. 6,604,786 to Benden et al., issued Aug. 12, 2003, incorporated by reference in its entirety herein, (and commonly-owned by the present assignee of record, Neutral Posture, Inc. of Bryan, Tex.) describes using a support apparatus that is removably attachable to an armrest of a chair, the back of a chair, or to a desk. In this way, accessories, such as computer, keyboard, and/or a mouse, can be utilized by a person seated in the chair or standing near the chair. When the apparatus is attached to the back of the chair, the apparatus may be utilized by a person in a standing position. The height of the apparatus may be adjusted by adjusting the height of the chair.

It is also known to provide some keyboard adjustment through the use of an industry-standard keyboard mechanism, such as those provided by CompX Waterloo Inc., Kitchener, Ontario, Canada, for example. The prior art keyboard mechanism systems may provide sufficient adjustment of a keyboard for a seated user, in some situations. However, the adjustability of prior art units may be limited such that the same equipment may not be utilized in conjunction with the sit-and-stand principle described above—at least not to the degree as dictated for an ergonomically-correct standing height of a $95^{th}$ percentile male.

Thus, it would be desirable to have one piece of equipment that would be capable of elevating a device such as a keyboard for utilization by a user in a seated position and in a standing position. It would also be desirable that the unit be able to be installed on existing keyboard mechanism as a retrofit, such that the sit and stand ergonomic principle may be utilized with existing keyboard mechanisms. It would also be desirable that the vertical adjustment mechanism be easily adjusted from one height to another.

Thus, a need exists for a single, versatile support adapted to vertically adjust devices such as a keyboard, mouse, or laptop computer, so that a user may utilize the device alternatively in a seated or standing position. It is desirable that this support be capable of attaching to a workstation, for instance via an industry-standard keyboard mechanism, in such a way as to let the user sit or stand throughout the day, thus reducing worker fatigue. It is therefore desirable that the attachment mechanism be simple to use so that the user can change positions as desired.

SUMMARY OF THE INVENTION

A vertical adjustment apparatus is described that is attachable to a work station by a keyboard mechanism. The vertical adjustment apparatus includes a base tray attachable to the keyboard mechanism, an upper tray to support a device at an adjustable height above the base tray, a first leg having an upper end functionally associated with the upper tray and a lower end slidably associated with the lower tray; and a second leg having a lower end functionally associated with the base tray and an upper end slidably associated with the upper tray, wherein the predetermined height may be adjusted from a first height to accommodate a user utilizing the device in a seated position, to a second height to accommodate the user in a standing position. In some embodiments, the upper end of the first leg is pivotally attached to the upper tray and the lower end of the second leg is pivotally attached to the base tray.

Some embodiments may include locking means to selectively lock the upper tray at a predetermined height above the base tray. The locking means may be a member pivotally mounted to the first leg, the member having at least one notch, and a post in the second leg to selectively engage one of the at least one notches to selectively lock the upper tray at a predetermined height. In some embodiments, the vertical adjustment apparatus further comprises power means to raise and lower the upper tray over the lower tray, which may be a pneumatic device, for example. In some embodiments, the vertical adjustment apparatus may be simply placed on a desk top, and may or may not include a base tray.

A method of elevating a device is also described such that the device may be utilized by a user alternatively between a seated and a standing position.

The vertical adjustment apparatus disclosed herein extends the current range of height-adjustability that is available in one workstation configuration and allows the user to avoid the cost of adding an expensive adjustable tables or other additional equipment. This allows one piece of equipment to be utilized to reach full standing work postures. Prior art keyboard trays generally comprise one of two basic varieties: desk level to a given distance below, or (2) desk level to a given distance above or below desk level. As such, prior art units generally are not compatible with a standing keyboard user, as the additional given distance is below an ergonomically-correct height of a $95^{th}$ percentile male. Further, by utilizing industry-standard hole configurations, the vertical adjustment apparatus is universal, and may be incorporated into any workstation configuration generally.

BRIEF DESCRIPTION OF THE DRAWINGS

FIG. 1C being a front view, FIG. 1D being a left side view; FIG. 1E being a front perspective view, FIG. 1F being a rear perspective view, and FIG. 1G being a perspective view with cutaways.

Figure 1C:
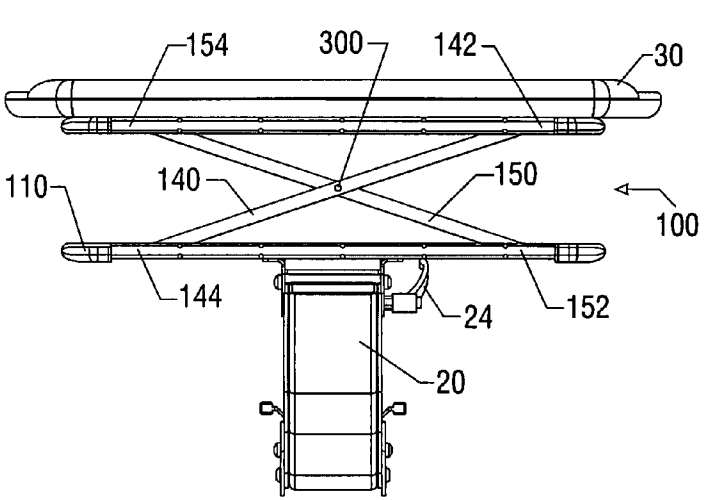
FIGS. 1A–G show various aspects of one embodiment of a vertical adjustment apparatus in which the upper tray is adjusted to a predetermined height above a base tray, FIG. 1A being a top view, FIG. 1B being a right side view.
Figure 1D:
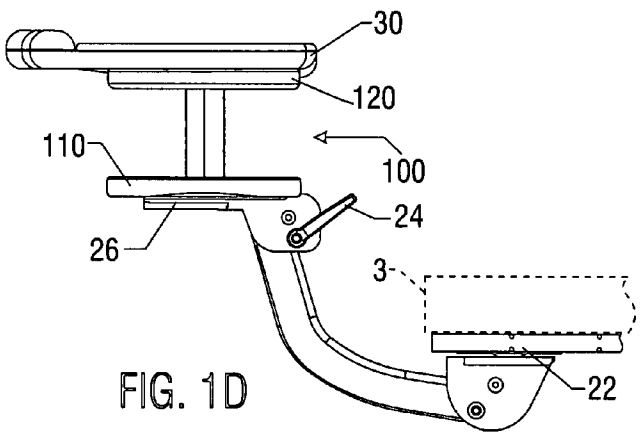
Figure 1A:
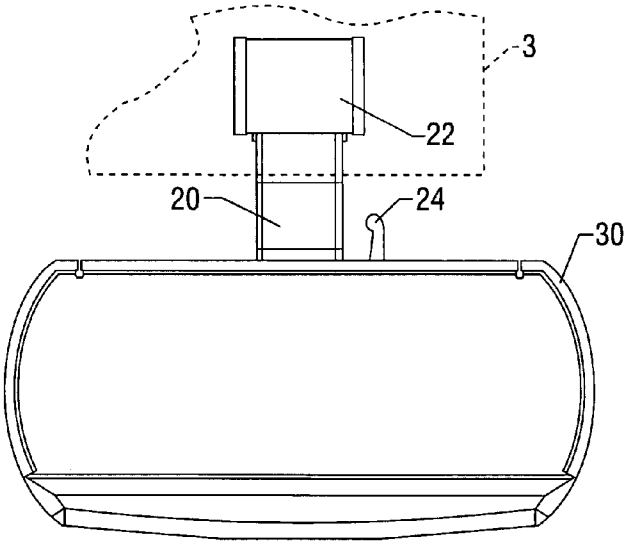
Figure 1B:
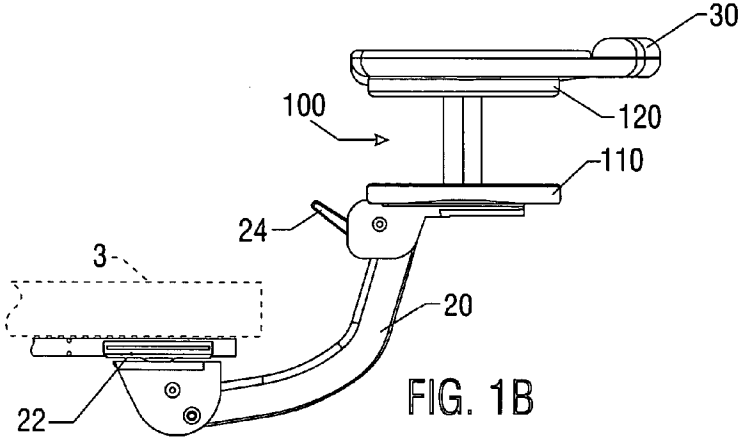
Figure 1E:
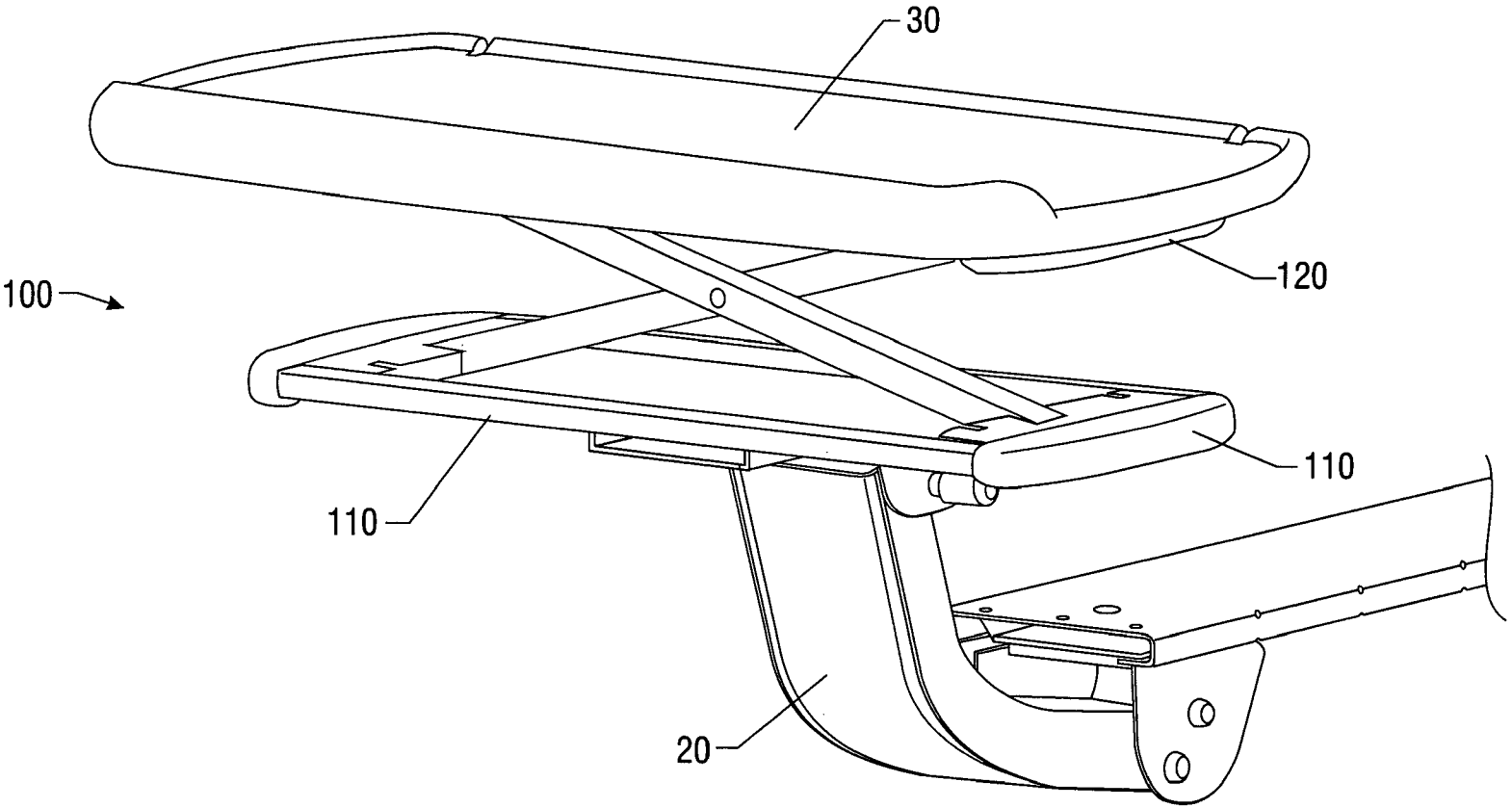

While the invention is susceptible to various modifications and alternative forms, specific embodiments have been shown by way of example in the drawings and will be described in detail herein. However, it should be understood that the invention is not intended to be limited to the particular forms disclosed. Rather, the intention is to cover all modifications, equivalents and alternatives falling within the spirit and scope of the invention as defined by the appended claims.

DESCRIPTION OF ILLUSTRATIVE EMBODIMENTS

The invention relates to an apparatus and a method to vertically adjust the height of a device for so that an operator may utilize the device in both a seated and standing position as desired. In this way, a single device may be added to a traditional keyboard/keyboard mechanism configuration, which allows the keyboard to be used in both a seated and standing position. In each of these embodiments, the advantage of using one piece of furniture to support the accessories while the user is seated or standing is utilized. Thus, cost and space is reduced compared to using two pieces of furniture to employ the sit and stand principle.

Illustrative embodiments of the invention are described below as they might be employed in the use of a vertical adjustment apparatus that can be utilized to elevate a device, such as a keyboard, mouse, or laptop computer. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Further aspects and advantages of the various embodiments of the invention will become apparent from consideration of the following description and drawings.

Referring to FIGS. 1A–F, various views of one embodiment of the present invention is shown comprising a vertical adjustment apparatus 100 which is attachable to a keyboard mechanism 20 of the prior art. Keyboard mechanism 20 is attachable to a workstation 3, such as a desk, via a mount 22 on the underside of the workstation. Further, in typical prior art keyboard mechanisms 20, a keyboard tray 30 is attached to the other end 26 of the keyboard mechanism 20. As would be known to one of ordinary skill in the art familiar with standard keyboard mechanisms, the height and location of the keyboard 30 is adjustable by depressing handle 24 (which allows for limited height adjustment) or by sliding the keyboard mechanism 20 toward or away from workstation 3, the keyboard mechanism being slidably attached to the workstation 3 via mount 22. Such a system and the utilization of that apparatus is described in U.S. Pat. No. 6,488,248 to Watt, incorporated by reference in its entirety.

While these keyboard mechanisms are designed to provide some vertical adjustment of the keyboard, sufficient adjustability is not generally provided to allow a user to utilize the sit-an-stand principle throughout the day.

In the embodiment shown in FIGS. 1A–I, the vertical adjustment mechanism 100 is attachable to both the industry-standard keyboard mechanism 20 and the industry-standard keyboard holder 30. The vertical adjustment apparatus 100 is shown interposed between the keyboard mechanism 20 and the keyboard holder 30.

The vertical adjustment mechanism 100 is shown in this embodiment as comprising a base tray 110, an upper tray 120, a first leg 140, and a second leg 150. The base tray 110 is attachable to the keyboard mechanism 20 at mount 26. The upper tray 120 is attachable to the keyboard holder 30 to support a device (not shown), such as a keyboard, a mouse, etc.

In this embodiment, the first leg 140 and the second leg 150 are connected at a pivot 300, the legs 140, 150 thus forming a scissor-like configuration. Legs 140 and 150 may comprise tubular steel members, while the base tray 110 and upper tray 120 may be stamped from sheet metal, for example. Of course, the embodiments are not limited to any particular materials of construction.

First leg 140 has one end 142 that is attachable to the upper tray 120 in this embodiment, and another end 144 that is slidably attachable to base tray 110. In this embodiment, end 142 of leg 140 is pivotally attached to the upper tray 120. In this embodiment, the lower end 144 of the first leg 140 is slidably attached to the base tray 110, as the lower end 144 of the first leg 140 is attached to a slidable member such as a rod 146. The ends 148 of rod 146 are adapted to slide within channels 112 in the base tray 110 in this embodiment, the channels 112 being described in more detail below.

Similarly, second leg 150 has one end 152 that is attachable to the base tray 110 in this embodiment, and another end 154 that is slidably attachable to the upper tray 120. In this embodiment, lower end 152 is pivotally attached to the base tray 110. In this embodiment, the upper end 154 of the second leg 150 is slidably attached to the upper tray 120, the upper end 154 of the second leg 150 being attached to a slidable member such as a rod 156. The ends 158 of rod 156 are adapted to slide within channels 122 in the upper tray 120 in this embodiment.

Figure 1F:
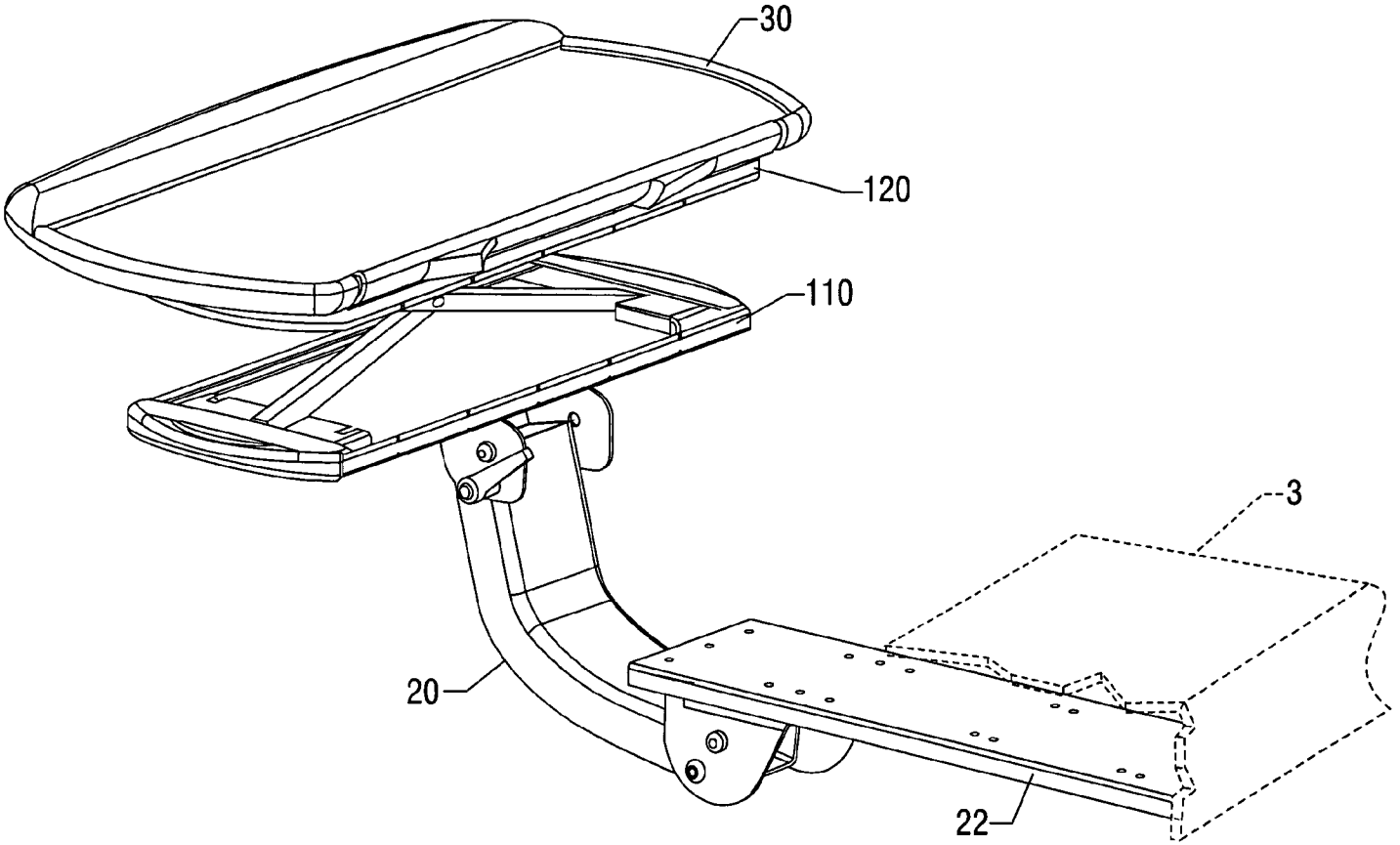
Figure 1G:
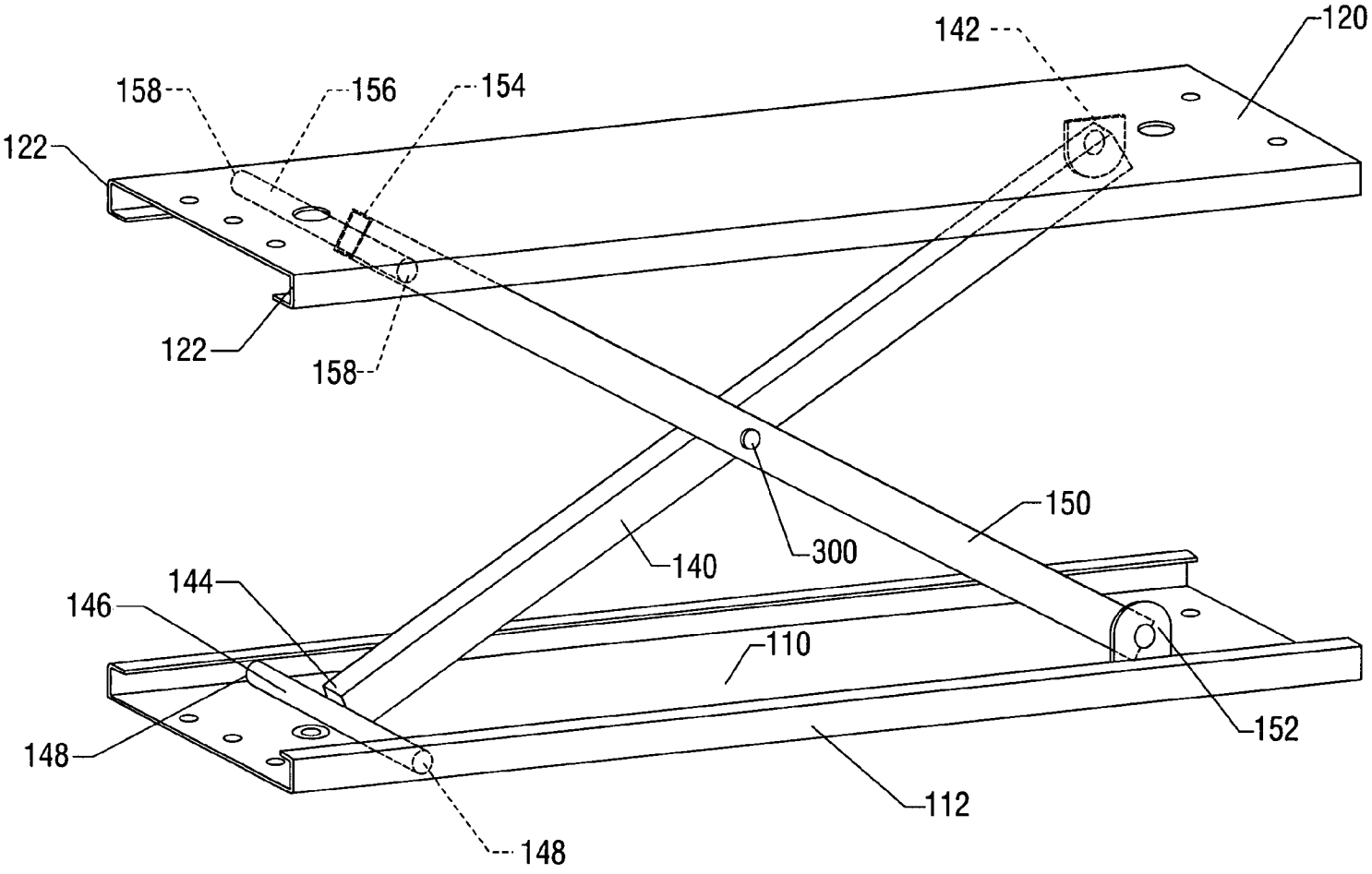
Figure 1H:
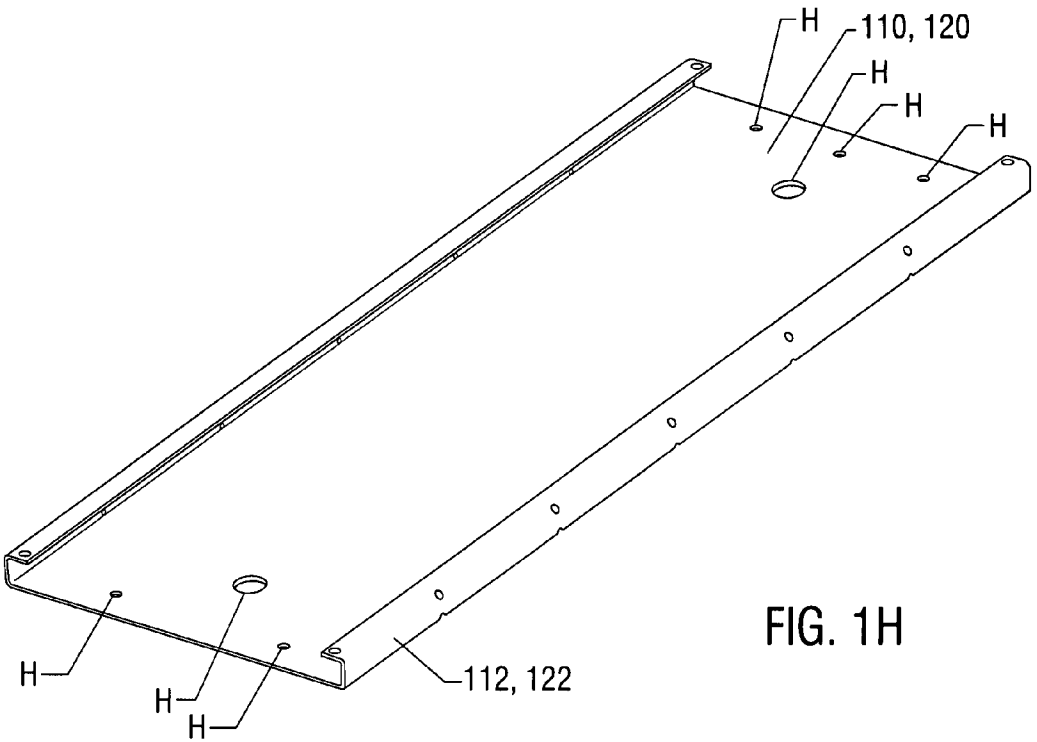
FIG. 1H shows a perspective view of the trays 112, 122 of one embodiment of the present disclosure.
Figure 1I:
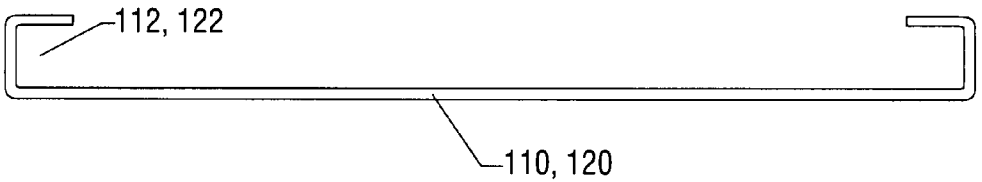
FIG. 1I shows an end view of the trays of FIG. 1H.
Figure 2A:
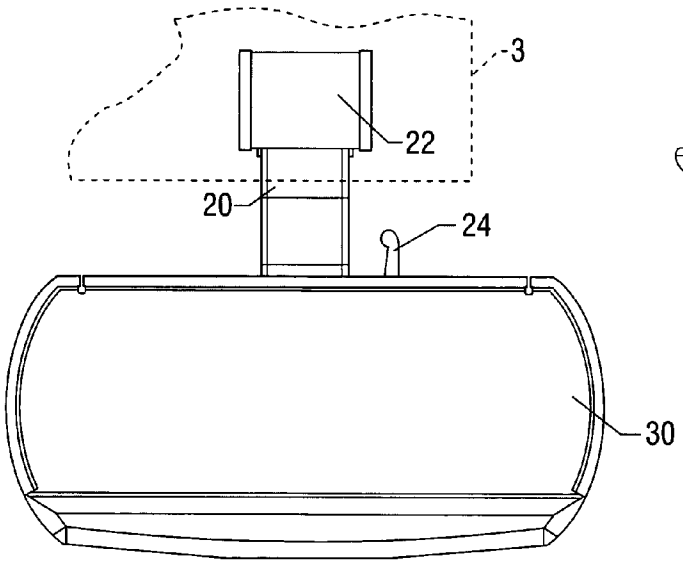
FIGS. 2A–E shows an embodiment of the present invention in which an upper tray is at a lowest point, and in contact with, the lower tray of one embodiment of the present invention, FIG. 2A being a top view, FIG. 2B being a right side view, FIG. 2C being a rear review, FIG. 2D being a left side view, and FIG. 2E being a rear perspective view.
Figure 2C:
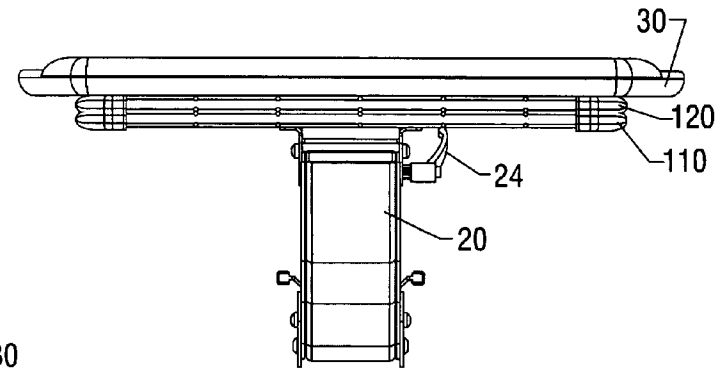
Figure 2B:
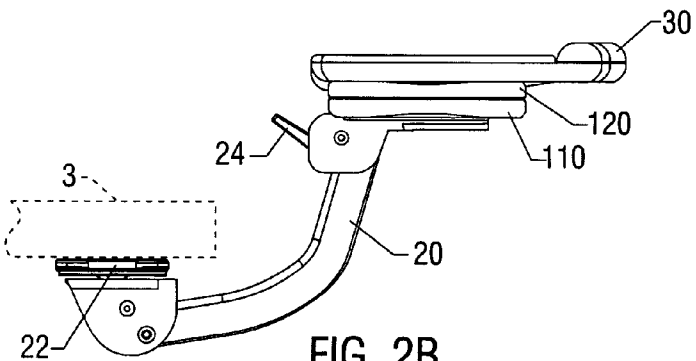
Figure 2D:
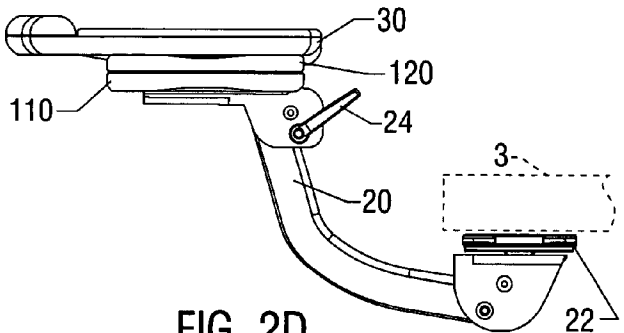
Figure 2E:
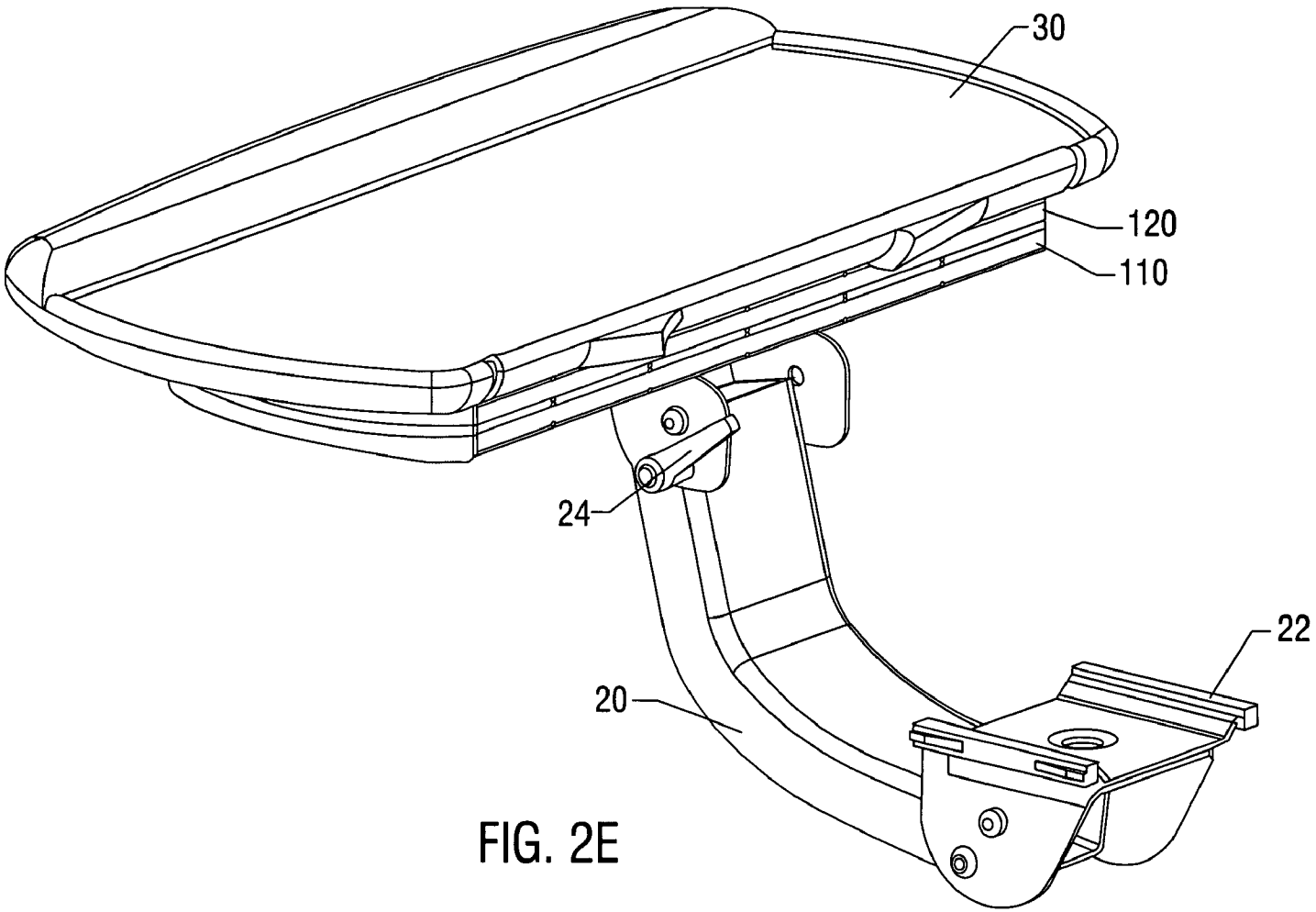
Figure 3A:
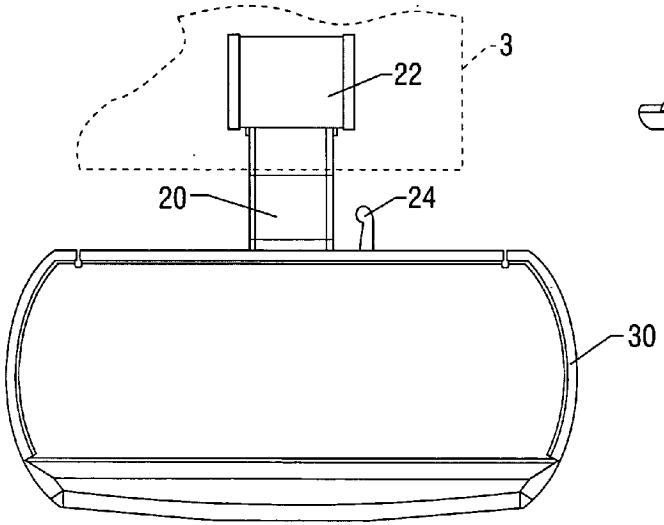
FIGS. 3A–3E show an embodiment of the present invention having a third and fourth leg, FIG. 3A being a top view, FIG. 3B being a right side view, FIG. 3C being a rear review, FIG. 3D being a left side view, and FIG. 3E being a rear perspective view.
Figure 3C:
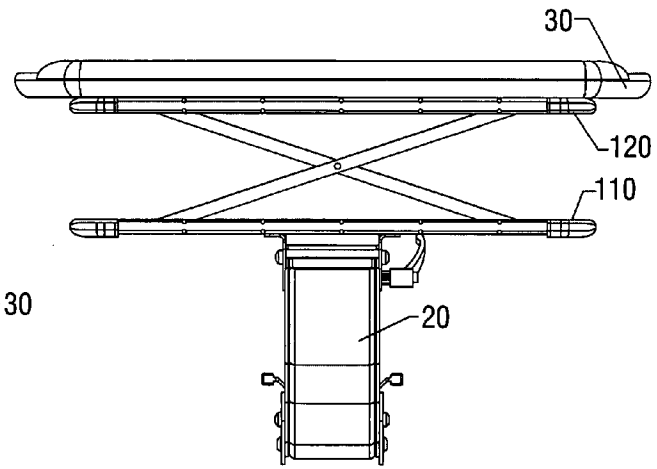
Figure 3B:
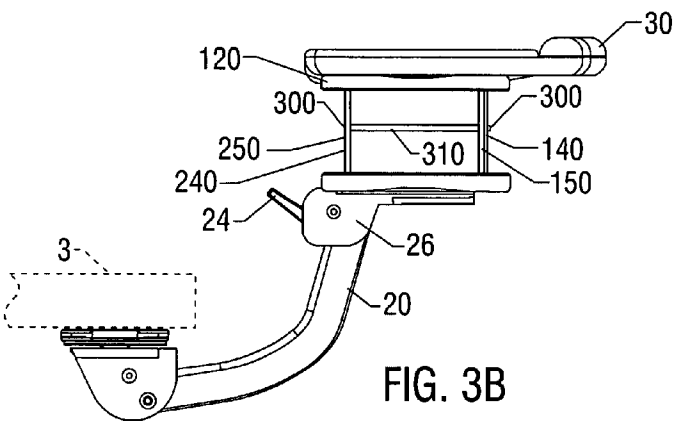
Figure 3D:
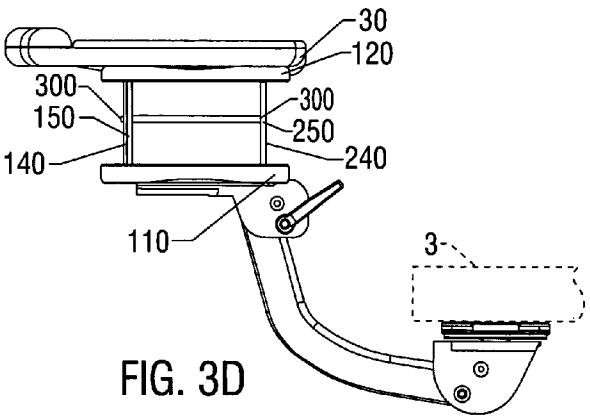
Figure 3E:
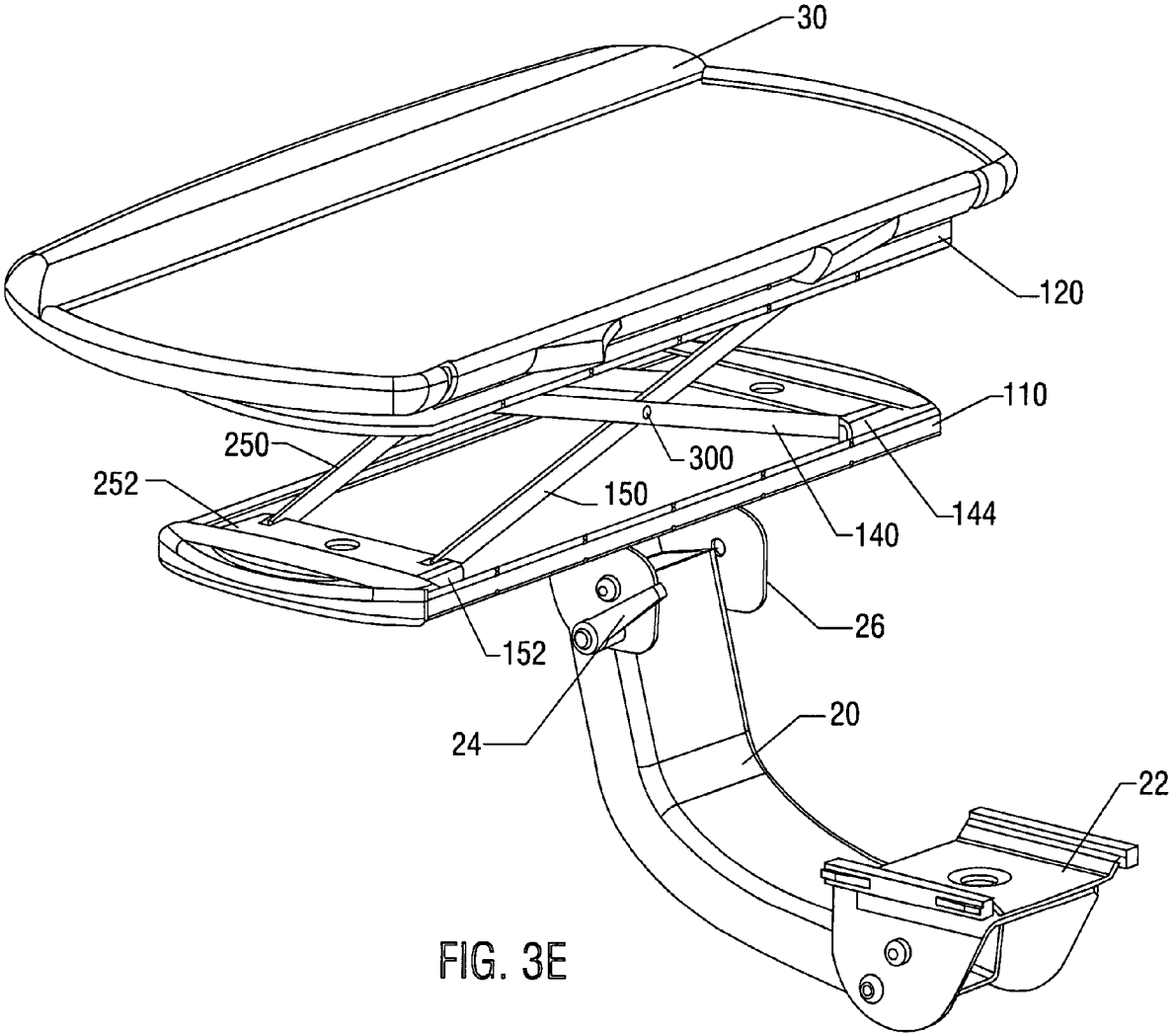

As shown most clearly in FIGS. 1G–I, upper and lower trays 120, 110 may further comprise channels 122, 112 respectively therein. Channels 122, 112 may comprise a C-shape on the periphery of the trays 120, 110 along a longitudinal axis of the trays 120, 110. It should be noted that in some embodiments, the trays 120, 100 may be identical—thus reducing manufacturing costs—the upper tray 120 being inverted prior to assembly. In some embodiments, as shown in FIG. 1H, the mounting holes "H" in trays 120, 110 may be arranged such the holes correspond to industry standard configurations; thus, the elevation apparatus 100 may be interposed between an industry-standard keyboard tray and an industry-standard keyboard mechanism, with relative ease without the need to drill additional holes.

The vertical adjustment apparatus described with respect to some embodiments herein is adapted to provide vertical adjustment of the height of the upper tray 120 over the base tray 110. FIGS. 2A–2E show the apparatus 100 in which the upper tray 120 is in its lower-most position with respect to the base tray 110. In other words, the adjustable height of the upper tray 120 over the base tray 110 is at its minimum value, as the upper tray 120 and the base tray 110 are in contact.

In contrast, referring to FIGS. 1A–G, the upper tray 120 has been adjusted to a predetermined height "h" in FIGS. 1A–1G. As described more fully hereinafter, the predetermined height "h" may be adjusted to any number of heights to accommodate the desires of the user or users.

Returning to FIG. 1G, in operation, the upper tray 120 is movable vertically over base tray 110 as follows. As an upward force is applied to the upper tray 120 by a power means (described more thoroughly hereinafter), the vertical distance between the upper tray 120 and base tray 110 increases to a height "h." As the upper tray 120 is raised, ends 142 and 152 move with respect to the upper tray 120 and base tray 110 respectively. In this embodiment, the ends 142, 152 pivot about pins attached to upper and lower trays 120, 110 respectively. Concomitantly, ends 154, 144 slidably move with respect to longitudinal axes of the upper and lower trays 120, 110. In this embodiment, the ends 158 on rod 156 of end 154 of the first leg 150 slide within channels 122 of the upper tray 120, while the ends 148 on rod 146 of end 144 of the first leg 140 slide within channels 112 of base tray 110.

It should be mentioned that in some embodiments, the apparatus as shown in FIG. 1G is placeable directly on a desk top and may be utilized to raise and lower a keyboard such that the sit-and-stand principle may be utilized. That is, the vertical adjustment apparatus is not connected to the keyboard mechanism or arm in these embodiments. Further, in some embodiments of this desk-top version, the base tray 110 is not required, the lower ends 144, 152 of the first and second legs 140, 150 contacting the desk top directly. The other features described herein (locking means, power means, etc.) may be utilized with this desk-top version.

In some embodiments, a locking means may be provided to selectively lock the upper tray 120 at a given predetermined, adjustable height above the base tray 110. The locking means will be discussed in more detail hereinafter.

In these embodiments, one end 142, 152 of each leg 140, 150 may be pivotally attached to a tray 120, 110. It has been determined that this method of attachment acts to ensure that the upper tray 120 remains aligned above the lower tray 100 as the upper tray is elevated. While this may be preferable in some embodiments, it is also possible to allow both ends 142, 144 of the first leg 140 and both ends 152, 154 of the second leg 150 be slidably attachable to the upper and lower trays 120, 110.

It should be noted that in FIGS. 1C and 1F, the ends 142, 152 of legs 140, 150 are pivotally attached to the trays 120, 110, while ends 144, 154 of legs 140, 150 are slidably attached to the trays 110, 120. As shown, the pivotally-attached end corresponds to the user's right side as the user is operating the device such as a keyboard to the upper tray 120. It has been determined that in some instances, this configuration is preferable; however, as would be readily apparent to one of ordinary skill in the art having the benefit of this disclosure, the ends 144, 154 of legs 140, 150 corresponding to the user's left side could be pivotally attached, with the other ends 142, 152 slidably attached to the trays 120, 110. Alternatively, as described above, all ends 142, 144, 152, 154 could be slidably attachable to the trays 110, 120.

Although the rods 146, 156 within channels 112, 122 are shown, any type of slidable attachment could be utilized, as would be known to one of ordinary skill in the art having the benefit of this disclosure. For instance, a rod may be affixed to a tray to run along the longitudinal axis of each tray, with a slidable attachment means movably connecting an end of a leg to the rod, for example.

As described above, the vertical adjustment apparatus 100 may be used with conventional office equipment, to provide additional elevation of a device, such as a keyboard, that is in addition to any vertical adjustment provided by a prior art keyboard mechanism. This additional elevation allows the device to be utilized by a user in a seated position as well as in the standing position, not previously possible. By way of example, in some embodiments, the vertical adjustment apparatus 100 may provide an additional height to a standard keyboard mechanism mounted to a workstation, such as a desk, such that the apparatus 100 allows the device to be elevated to a $95^{th}$ percentile standing elbow rest height. This additional height allows the user to operate a device, such as a keyboard on the keyboard mechanism or on the desk top, while standing, without adding other equipment to the work area to elevate the keyboard. Further, as the height "h" may be adjusted to various heights, the vertical adjustment apparatus allows the same keyboard mechanism to be utilized to accommodate various users who may be assigned to the given workstation over time.

FIGS. 3A–E show another embodiment of the present invention further comprising a third leg 240 and a fourth leg 250. Third leg 240 has one end 242 that is attachable to the upper tray 120 in this embodiment, and another end 244 that is slidably attachable to base tray 110. In this embodiment, end 242 of leg 240 is pivotally attached to the upper tray 220. In this embodiment, the lower end 244 of the first leg 240 is slidably attached to the base tray 110 via rod 146 sliding in channels, as described with respect to the previous embodiments. The other components are similar to those previously discussed, as is the operation of this embodiment. Similarly, fourth leg 250 has one end 252 that is attachable to the base tray 110 in this embodiment, and another end 254 that is slidably attachable to the upper tray 120. In this embodiment, lower end 252 is pivotally attached to the base tray 110. In this embodiment, the upper end 254 of the second leg 250 is slidably attached to the upper tray 120, the upper end 254 of the second leg 250 being attached to a slidable member as described with respect to the embodiments of FIGS. 1A–G. Further, in this embodiment, pivots 300 may be connected by a member 310.

Figure 4:
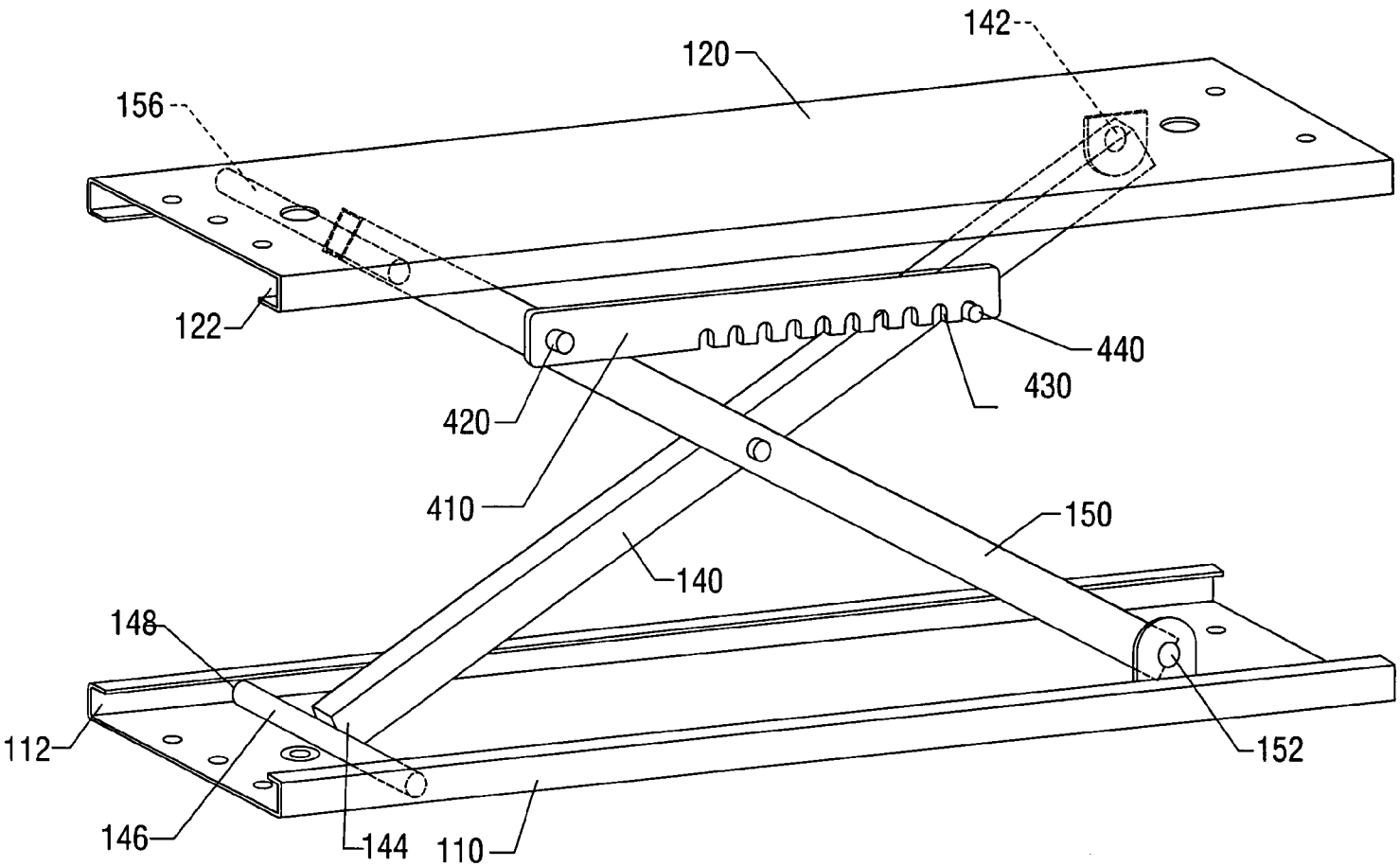
FIG. 4 shows an embodiment of a locking mechanism on the vertical adjustment apparatus of one embodiment of the present invention.

FIGS. 4–6B show various embodiments of locking means to selectively lock the upper tray 120 at one of any number of predetermined heights above the base tray 110. FIG. 4 shows a means for locking comprising a member 410 pivotally mounted to the second leg 150 by a pin 420. The member 410 has a plurality of notches 430, each one of the plurality of notches 430 corresponding to a predetermined height of the upper tray 120 over the base tray 110. A post 440 is provided in the first leg 140. Once the upper tray 120 is at a desired predetermined height, the member 410 is pivotally rotated that one of the plurality of notches 430 mates with the post 440 to lock the upper tray 120 at a given height over the base tray 110. Of course, in other embodiments, the member 410 may be pivotally attached to the first leg 140 with the post on the second leg 150.

Figure 5A:
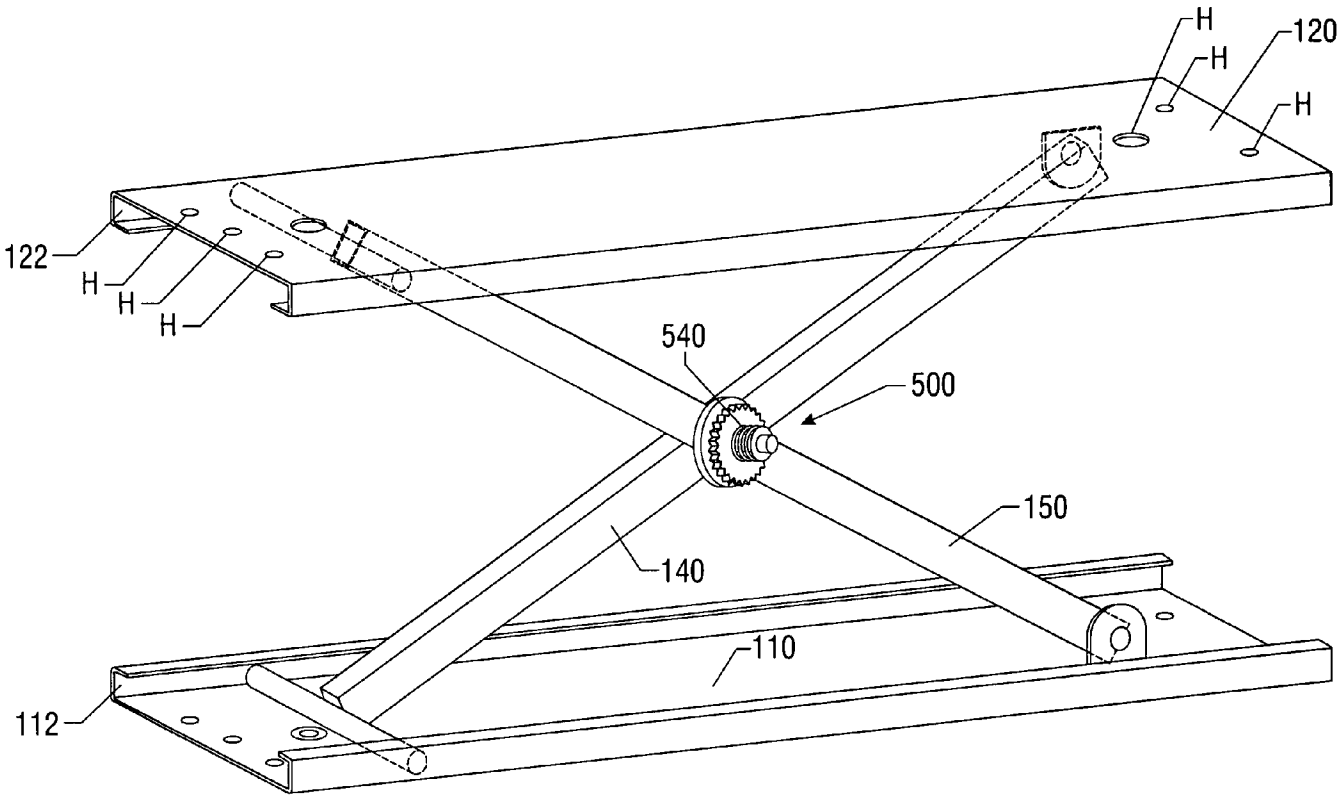
FIGS. 5A and 5B show a frustoconical locking mechanism on a vertical adjustment apparatus of one embodiment of the present invention.
Figure 5B:
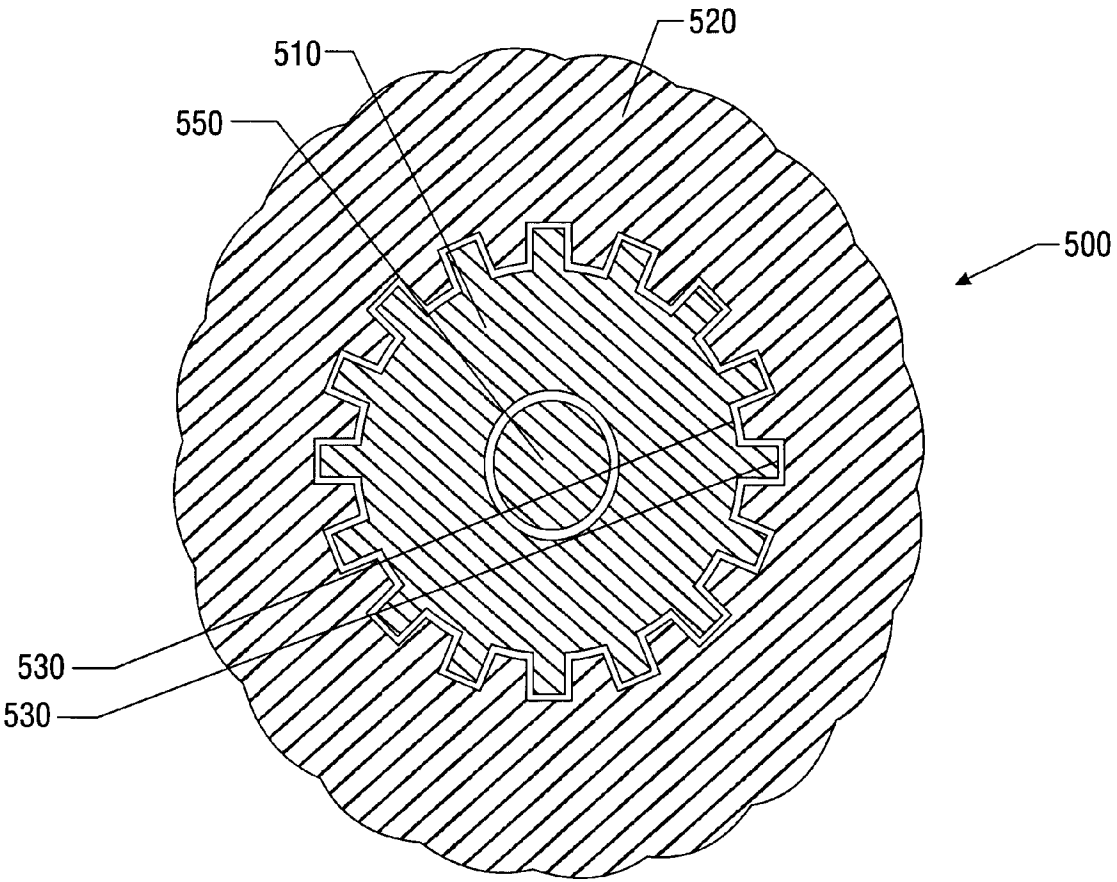

FIGS. 5A and 5B show another locking means for selectively locking the upper tray at a predetermined height above the base tray 110, comprising a frustoconical member 500. The frustoconical member 500 operates similar to the frustoconically-shaped first and second members of U.S. Pat. No. 6,296,312 to Congleton et al., incorporated by reference in its entirety. The frustoconical member 500 is comprised of a first locking member 510, a second locking member 520, each having locking teeth 530 adapted to mate with each other when in contact. The first and second locking members 510 and 520 are biased toward each other via a spring 540 circumscribing a pin 550. The first and second locking members 510, 520 also circumscribe pin 550. When the locking members 510 and 520 are in contact, the upper tray 120 is locked at a predetermined height above the base tray 110. To adjust the height, a user applies an outward force to overcome the biasing force of the spring 540, thus separating the locking members 510, 520, which allows the upper tray 120 to move vertically with respect to the base tray 110. Upon release of the force, the teeth 530 of the locking members 510 and 520 interlock due to the biasing force of the spring 540.

Of course, in other embodiments, the means for selectively locking may comprise a simple bolt passing through pivot 300 and adapted to have a nut tightened on the bolt once the desired predetermined height may be attached.

Figure 6A:
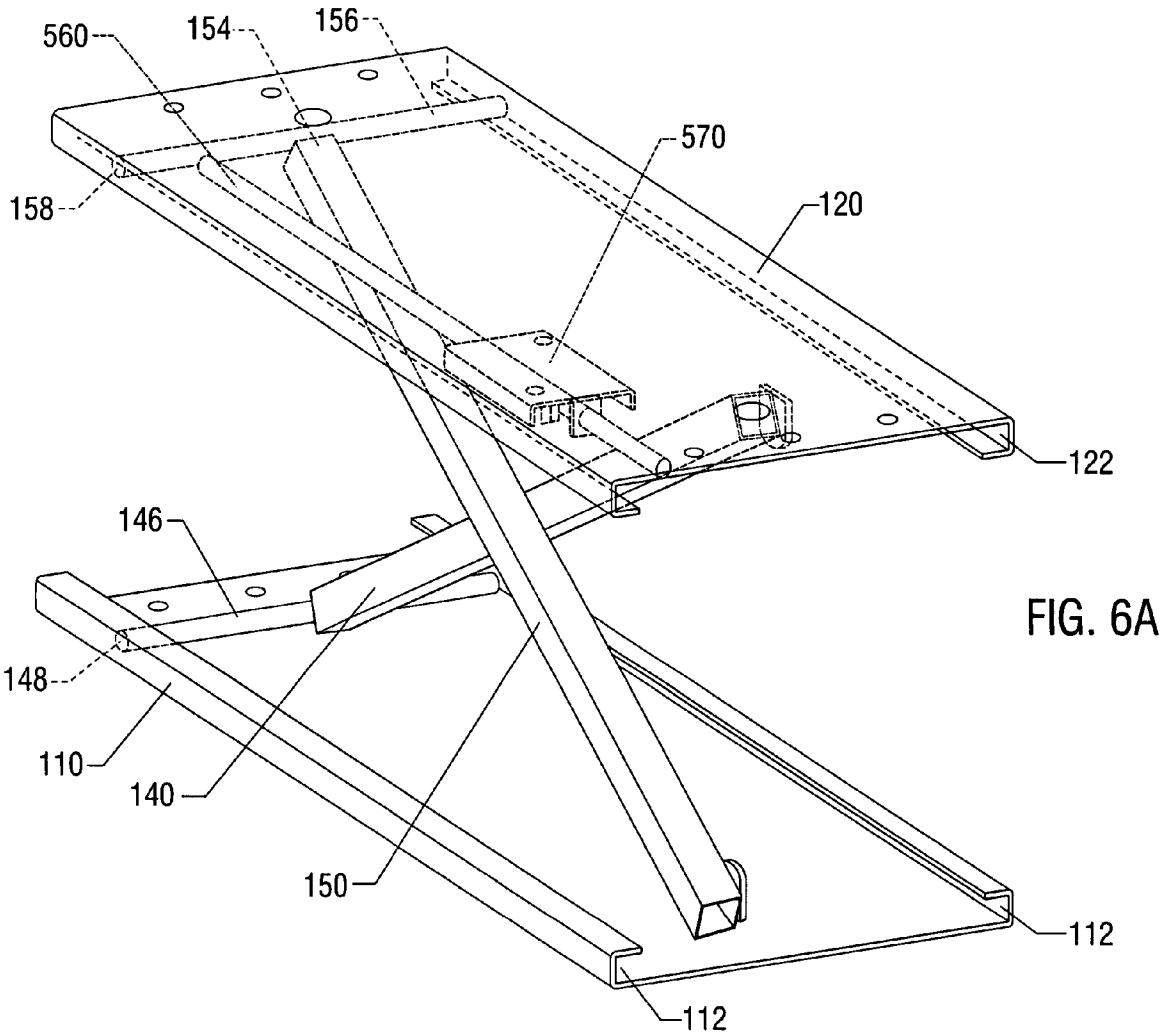
FIGS. 6A–6C show a slidable member of a locking mechanism on a vertical adjustment apparatus of one embodiment of the present invention.
Figure 6B:
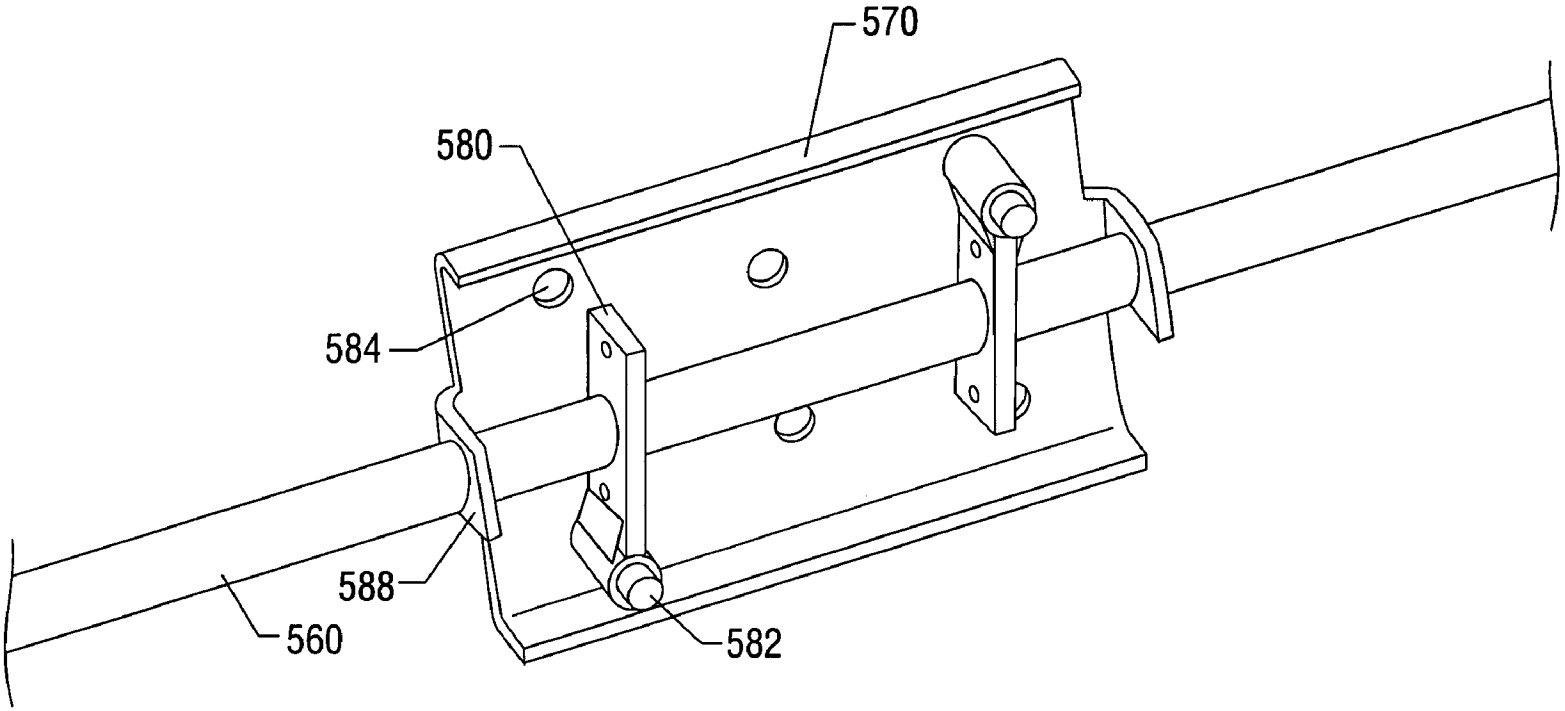
Figure 6C:
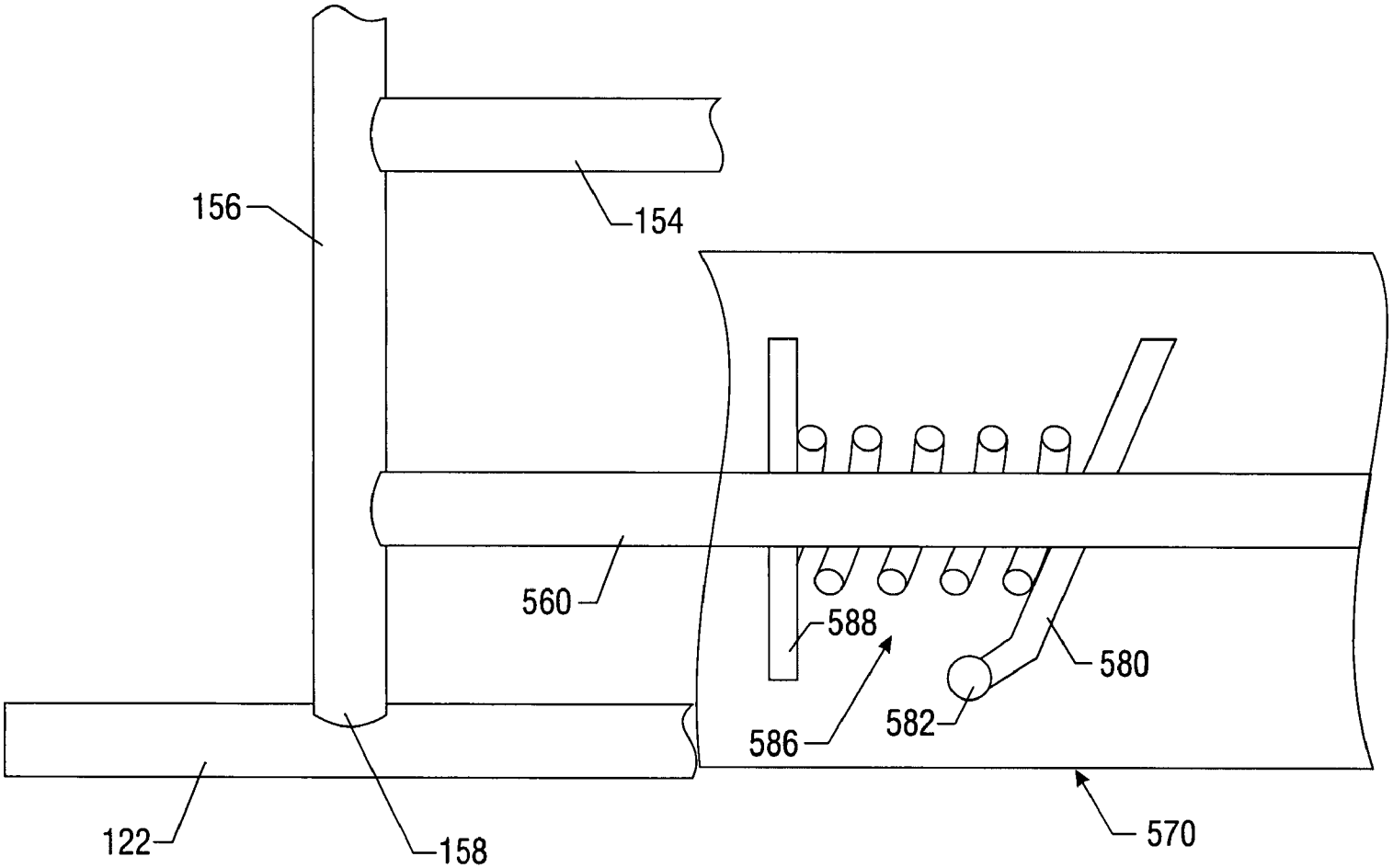

FIGS. 6A–C show another means for selectively locking the upper tray 120 at a predetermined height above the base tray 110, comprising a locking rod 560 running along a longitudinal axis of the upper tray 120, the locking rod 560 being fixed at one end to the upper tray 120, and to rod 156 on the other end. Recall rod 156 is attached on the upper end 154 of the second leg 150; rod 156 has ends 158 to slidably engage the channel 122 in the base tray 120. Alternatively, the rod 560 could be functionally associated with the base tray 110 instead of upper tray 120, in other embodiments. A slidable member 570 is adapted to circumscribe and to selectively engage the locking rod 560. As shown in FIG. 6B, slidable member may comprise at least one cam plate or toggle 580 hingedly mounted on pin 582. In one position, the locking rod 560 is free to pass through the hole in the toggle 580 and relative movement between the slidable member 570 and the rod 560 is possible. As the toggle 580 is angled with respect to rod 560, the toggle 580 pinches the rod 560 such that relative movement between the rod 560 and the slidable member 570 is prevented. The toggle 580 may be selectively secured in this position via a pin mating with a hole 584 in the slidable member 570 or by any other securing means. In this position, the upper tray 120 is therfore locked at a predetermined height above the base tray 110.

In other embodiments, and as shown in FIG. 6C, a spring 586 may bias the toggle 580 in the locked position. A user may apply a force to the toggle 580 thus overcoming the biasing force of the spring 586 to allow the slidable member 570 to move along the rod 560. The spring 586 may be compressed between the toggle 580 and the stationary wall 588 also mounted to the slidable member 570.

To adjust the height of the upper tray 120 over the base tray 110 in this embodiment, a user pushed on the toggle 580 to overcome the biasing force of the spring 586, the toggle 580 pivoting on pin 582. In this position, the toggle 580 is allowed to move angularly such that the slidable member 570 is movable with respect to the locking rod 560. When the user releases the force on the toggle 580, the spring 586 acts to bias the toggle 580 to lock against rod 560, thereby locking the upper tray 120 at a desired predetermined height over the lower tray 110. As would be known to one of ordinary skill in the art having the benefit of this disclosure, any number of slidable members having toggles 580 and springs 586 may be connected to locking rod 560. For example, two slidable members 570 may be utilized: one to prevent the slidable member 570 moving to the right along locking rod 560, and one to prevent the slidable member 570 from moving to the left along locking rod 560.

Figure 7:
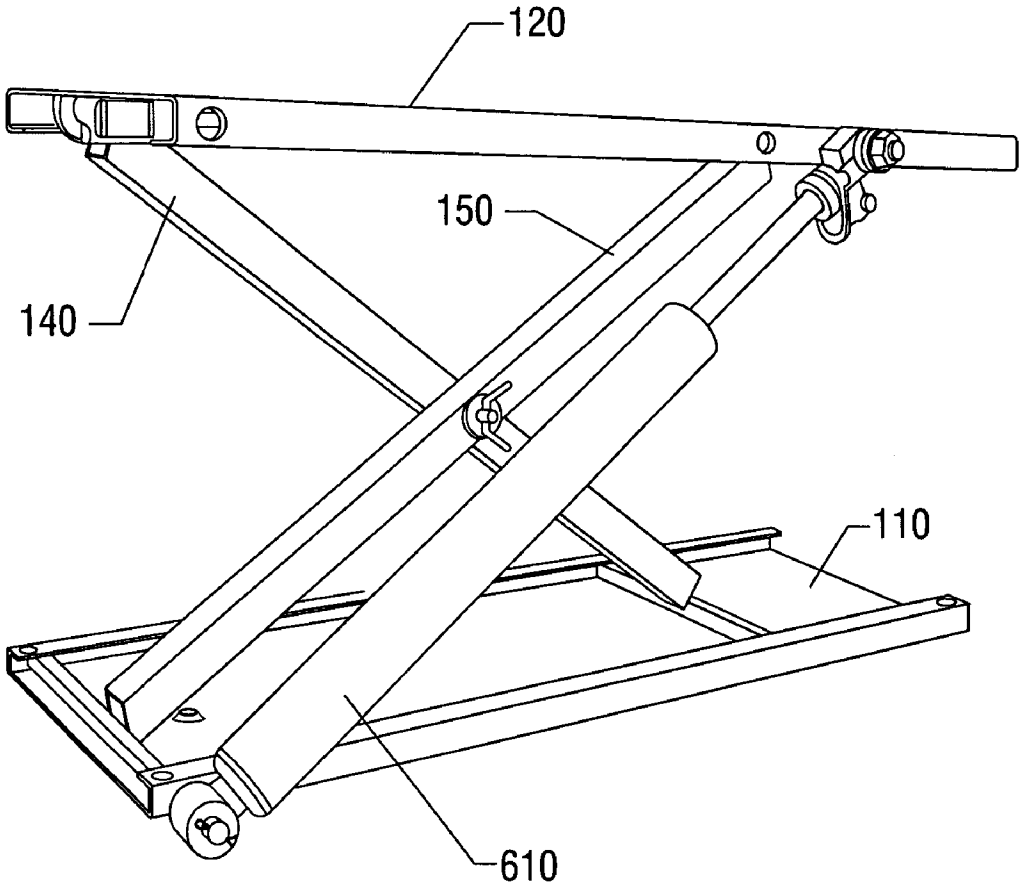
FIG. 7 shows a pneumatic power means of one embodiment of the present invention.

As described above, some embodiments include a power means to adjust the height of the upper tray 120 above the base tray 110. The power means could include a user manually pulling upwardly on the upper tray 120. Alternatively, a power means may include a pneumatic device 610 as shown in FIG. 7, interposed between the upper tray 120 and the base tray 110 in any configuration. Pneumatic device 610 may comprise a gas lift, such as the one commercially available from Suspa of Germany, for example. As would be realized by one of ordinary skill in the art, such gas lifts may assist in raising the upper tray 120 (i.e. providing counter-balanced functionality), and resist in lowering the upper tray 120, or vise versa.

Figure 8:
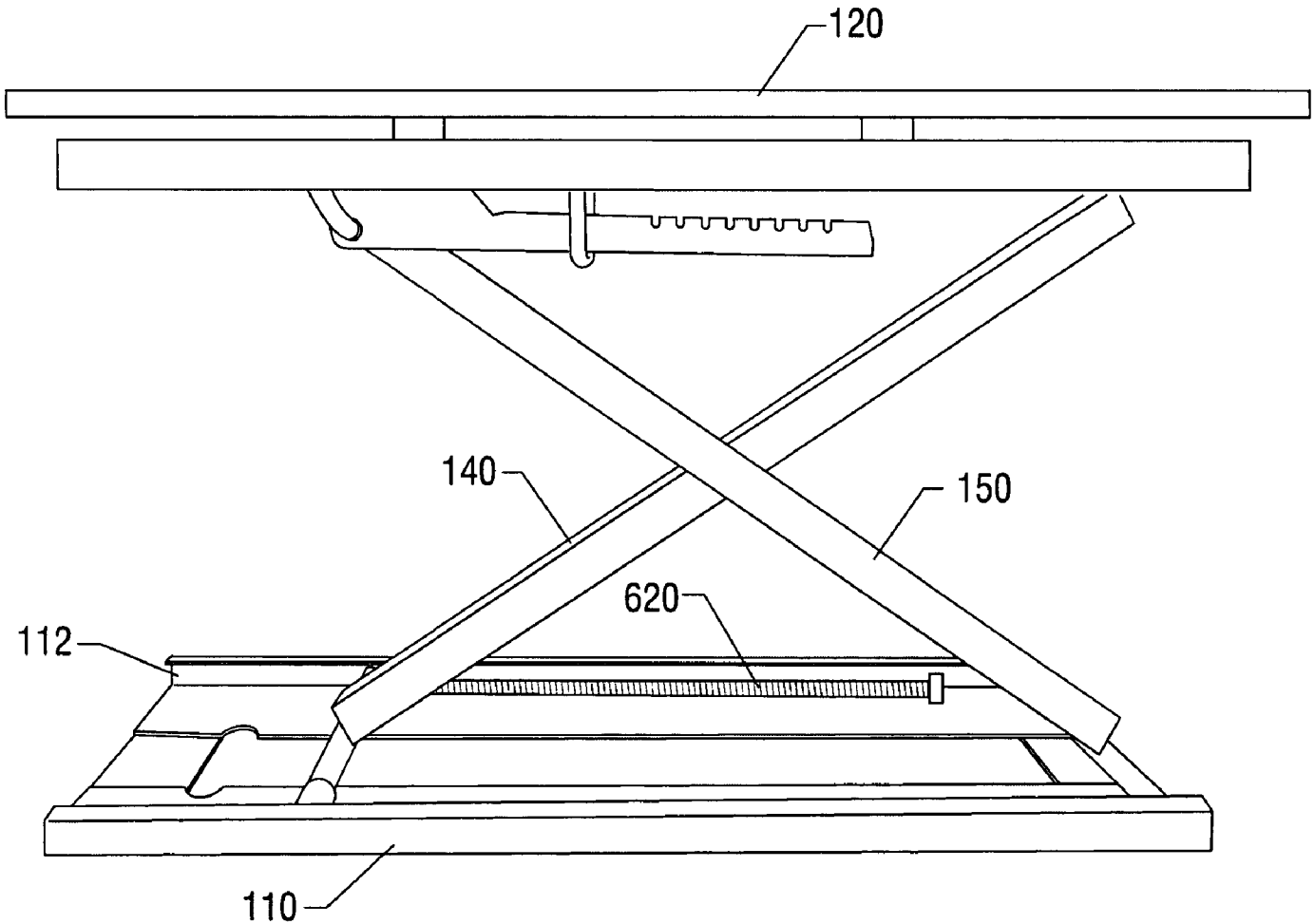
FIG. 8 shows a lead screw power means of one embodiment of the present invention.

Referring to FIG. 8, the power means to elevate the upper tray 120 over the lower tray 110 could comprise a lead screw 620 rotatably attached to the base tray 110. One of the lower ends 144 or 152 of either the first leg 140 or second leg 150 in these embodiments is connected via attachment means to the engage the thread of the lead screw 620. An electric motor may be utilized to rotate lead screw 620. As the electric motor turns the lead screw 620, the height of the upper tray 120 over the lower tray 110 is changed, being raised or lowered depending on the direction of rotation of the lead screw 620. When the motor is turned off, the lead screw 620 acts to lock the upper tray 120 at the predetermined height above the lower tray 110, thus acting as a locking means described above.

Further, the power means to elevate the upper tray 120 over the lower tray 110 may comprise a spring compressed to bias the lower ends 144, 152 of the legs 140, 150 toward each other.

Although various embodiments have been shown and described, the invention is not so limited and will be understood to include all such modifications and variations as would be apparent to one skilled in the art.

The following table lists the description and the reference numbers as used herein and in the drawings attached hereto.

| Number | Name |
|---|---|
| 3 | Workstation |
| 20 | Keyboard Mechanism |
| 22 | Workstation Mount |
| 24 | Handle |
| 26 | Mount |
| 30 | Keyboard Tray |
| 100 | Vertical Adjustment Apparatus |
| 110 | Base/Lower Tray |
| 112 | Channels in Base Tray |
| 120 | Upper Tray |
| 122 | Channels in Upper Tray |
| 140 | First Leg |
| 142 | Upper end of First Leg |
| 144 | Lower End of First Leg |
| 146 | Rod on First Leg |
| 148 | Ends of Rods |
| 150 | Second Leg |
| 152 | Lower End of Second Leg |

-continued

| Number | Name |
|---|---|
| 154 | Upper End of Second Leg |
| 156 | Rod on Second Leg |
| 158 | Ends of Rod on Second Leg |
| 240 | Third Leg |
| 242 | Upper End of Third Leg |
| 244 | Lower End of Third Leg |
| 250 | Fourth Leg |
| 252 | Lower End of Fourth Leg |
| 254 | Upper End of Fourth Leg |
| 300 | Pivot |
| 310 | Pivot Member |
| 410 | Member |
| 420 | Pin |
| 430 | Notch in Member |
| 440 | Post |
| 500 | Frustoconical Member |
| 510 | First Locking Member |
| 520 | Second Locking Member |
| 530 | Teeth |
| 540 | Spring |
| 550 | Pin |
| 560 | Locking Rod for Slidable Member |
| 570 | Slidable Member |
| 580 | Toggle |
| 582 | Pin of Toggle |
| 584 | Hole in Slidable Member |
| 586 | Spring |
| 588 | Stationary Wall |
| 610 | Pneumatic Cylinder |
| 620 | Lead Screw |

What is claimed is:

1. A vertical adjustment apparatus attachable to a workstation by a keyboard mechanism, the apparatus comprising:

a base tray attachable to the keyboard mechanism;

an upper tray to support a device at an adjustable height above the base tray;

a first leg having an upper end pivotally attachable to the upper tray and a lower end slidable along the base tray;

a second leg having a lower end pivotally attachable with the base tray and an upper end slidably attachable with the upper tray, wherein the adjustable height may be adjusted from a first height to accommodate a user utilizing the device in a seated position, to a second height to accommodate the user in a standing position; and locking means to selectively lock the upper tray at a predetermined height above the base tray, the locking means having a member pivotally attached to the second leg, the member having at least one notch; and a post in the first leg to selectively engage said at least one notch to selectively lock the upper tray at a predetermined height.

2. A vertical adjustment apparatus attachable to a workstation by a keyboard mechanism, the apparatus comprising:

a base tray attachable to the keyboard mechanism;

an upper tray to support a device at an adjustable height above the base tray;

a first leg having an upper end pivotally attachable to the upper tray and a lower end slidable along the base tray;

a second leg having a lower end pivotally attachable to the base tray and an upper end slidable along the upper tray, wherein the adjustable height may be adjusted from a first height to accommodate a user utilizing the device in a seated position, to a second height to accommodate the user in a standing position; and locking means to selectively lock the upper tray at a predetermined height above the base tray, the locking means having a rod running parallel with a channel in the upper tray and a slidable member attached to the upper way and circumscribing the rod, and selectively engaging the rod.

3. The vertical adjustment apparatus of claim 2, in which the slidable member comprises at least one toggle circumscribing the rod such that the slidable member is moveable along the rod when the toggle is in a first position, and the slidable member is locked on the rod when the toggle is in a second position.

4. The vertical adjustment apparatus of claim 3, in which the toggle is biased in the second position by a spring.

5. The vertical adjustment apparatus of claim 3 in which the toggle is pivotally mounted on the slidable member.

6. The vertical adjustment apparatus of claim 3 in which the toggle is held in the second position by a pin mating with a hole in the slidable member.

7. A vertical adjustment apparatus attachable to a workstation by a keyboard mechanism, the apparatus comprising:

a base tray attachable to the keyboard mechanism;

an upper tray to support a device at an adjustable height above the base tray;

a first leg having an upper end pivotally attachable to the upper tray and a lower end slidable along the base tray;

a second leg having a lower end pivotally attachable to the base tray and an upper end slidable along the upper tray, wherein the adjustable height may be adjusted from a first height adapted to accommodate a user utilizing the device in a seated position, to a second height adapted to accommodate the user in a standing position, the first and second legs being moveably attached at a pivot;

locking means to selectively lock the upper tray at a predetermined height above the base tray, the locking means having a frustoconical member functionally associated with a pivot, the first and second legs being moveably attached at the pivot;

at least one base channel in the base tray, the lower end of the first leg having a first rod to slidably engage the at least one base channel; and at least one upper channel in the upper tray, the upper end of the second leg having a second rod to slidably engage the at least one upper channel.

8. The vertical adjustment apparatus of claim 7, in which the frustoconical member further comprises:

a first locking member having teeth; and a second locking member having teeth, the teeth of the first locking member adapted to interlock with the teeth in the second locking member when the frustoconical member is in a first locking position, the first locking member being rotatable relative to the second locking member when the frustoconical member is in a second free position, the height of the upper tray being adjustable when the frustoconical member is in the second free position.

9. The vertical adjustment apparatus of claim 8, further comprising a spring to bias the frustoconical member toward the first locking position and a pin adapted to connect the first and second locking members.

10. The vertical adjustment apparatus of claim 7 further comprising power means to elevate the upper tray over the base tray.

11. The vertical adjustment apparatus of claim 10 in which the power means comprises a pneumatic device connectable between the upper tray and base tray.

12. The apparatus of claim 11 in which the pneumatic device comprises a gas lift device.

13. The vertical adjustment apparatus of claim 10 in which the power means comprises a rotatable lead screw functionally associated with the base tray, the lower end of the first leg being attachable to the thread of the lead screw by attachment means, the lower end of the first leg moving linearly along the lead screw as the lead screw is rotated, the movement of the first leg acting to change the height of the upper tray over the base tray.

14. The vertical adjustment apparatus of claim 13 in which the lead screw is selectively rotatable by an electric motor.

15. The vertical adjustment apparatus according to claims 1, 2, or 7, wherein a keyboard tray is attached to the upper tray, the device being a keyboard resting in the keyboard tray.

16. The vertical adjustment apparatus according to claims 1, 2, or 7 in which the first and second legs are moveably attached at a pivot.

17. The vertical adjustment apparatus as in claims 1, 2, or 7 in which the base tray and the upper tray are structurally identical.

18. The vertical adjustment apparatus according to claims 1, 2, or 7 further comprising:

a third leg having an upper end pivotably attachable to the upper tray and a lower end slidably attached with the base tray; and a fourth leg having a lower end pivotably attachable to the base tray and an upper end slidably along the upper tray.

19. The vertical adjustment apparatus of claim 18 in which the upper end of the third leg is pivotally attached to the upper tray and the lower end of the fourth leg is pivotally attached to the base tray.

20. A vertical adjustment elevation device for a desk, comprising:

an upper tray to support a keyboard at an adjustable height above a desk;

a first leg having an upper end pivotally attachable to the upper tray and a lower end slidable along the desk;

a second leg having a lower end pivotally attached to the desk and an upper end slidable along the upper tray, wherein the predetermined height may be adjusted from a first height to a second height; and a member pivotally attached to the second leg, the member having at least one notch, and a post in the first leg to selectively engage one of the at least one notch to selectively lock the upper tray at a predetermined height.

21. The apparatus of claim 20 further comprising a base tray, the lower end of the first leg slidably attached to the base tray, the lower end of the second leg pivotally attached to the base tray.

22. A method of elevating a device, comprising:

providing an apparatus having, a base tray attachable to a keyboard mechanism, the base tray having at least one base channel, an upper tray to support the device at an adjustable height above the base tray, the upper tray having at least one upper channel, a first leg having an upper end pivotally attachable to the upper tray and a lower end having a first rod to slidably engage the at least one base channel; on the base tray, and a second leg having a lower end pivotally attachable to the base tray and an upper end slidable along the upper tray, wherein the adjustable height may be adjusted from a first height adapted to accommodate a user utilizing the device in a seated position, to a second height adapted to accommodate the user in a standing position;

moving the upper tray from the first height to the second height by lifting the upper tray and sliding the lower end of the first leg within the base channel while sliding the upper end of the second leg along the upper tray, all the while pivoting the upper end of the first leg with the upper tray and pivoting the lower end of the second leg with the base tray; and locking the upper tray at the second height.

23. The method of claim 22, further comprising:

unlocking the upper tray at the first height, by releasing interlocking teeth of a first locking member of a frustoconical member with mating teeth of a second locking member;

lifting the upper tray from the first height to the second height while pivoting the first and second legs about a pivot, the frustoconical member being located at the pivot; and locking the upper tray at the second height by interlocking the teeth of the first locking member of the frustoconical member with mating teeth of a second locking member at the pivot between the first and second legs.

24. The method of claim 23 further comprising:

powering the upper tray to the second height by a pneumatic device.

25. A vertical adjustment apparatus attachable to a workstation by a keyboard mechanism, the apparatus comprising:

a base tray attachable to the keyboard mechanism;

an upper tray to support a device at an adjustable height above the base tray;

a first leg having an upper end pivotally attachable to the upper tray and a lower end slidably attachable with the base tray;

a second leg having a lower end pivotally attachable to the base tray and an upper end slidable along the upper tray, wherein the adjustable height may be adjusted from a first height adapted to accommodate a user utilizing the device in a seated position, to a second height adapted to accommodate the user in a standing position; and locking means to selectively lock the upper tray at a predetermined height above the base tray, the locking means having a member pivotally attached to the first leg, the member having at least one notch; and a post in the second leg to selectively engage one of the at least one notches to selectively lock the upper tray at the predetermined height.

* * * * *

UNITED STATES PATENT AND TRADEMARK OFFICE

CERTIFICATE OF CORRECTION

PATENT NO. : 7,048,236 B2
APPLICATION NO. : 10/767704
DATED : May 23, 2006
INVENTOR(S) : Mark E. Benden, Jerome J. Congleton and Christopher A. Smith It is certified that error appears in the above-identified patent and that said Letters Patent is hereby corrected as shown below:

In claim 2, Col. 10, Line 55, please change “way” to --tray--.

Signed and Sealed this

Twenty-second Day of August, 2006

JON W. DUDAS
*Director of the United States Patent and Trademark Office*